US007600397B2

(12) United States Patent
Vuletic

(10) Patent No.: US 7,600,397 B2
(45) Date of Patent: Oct. 13, 2009

(54) PROCESS AND INSTALLATION FOR GRANULATING SLAG

(75) Inventor: Bogdan Vuletic, Düsseldorf (DE)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 172 days.

(21) Appl. No.: 10/572,775

(22) PCT Filed: Sep. 17, 2004

(86) PCT No.: PCT/EP2004/010442

§ 371 (c)(1),
(2), (4) Date: Jun. 29, 2006

(87) PCT Pub. No.: WO2005/031008

PCT Pub. Date: Apr. 7, 2005

(65) Prior Publication Data

US 2007/0107466 A1 May 17, 2007

(30) Foreign Application Priority Data

Sep. 25, 2003 (AT) ..... A 1525/2003

(51) Int. Cl.
*C04B 5/02* (2006.01)
*C04B 5/00* (2006.01)

(52) U.S. Cl. ..... 65/19; 65/20; 65/141

(58) Field of Classification Search ..... 65/19, 65/20, 141; 164/509; 373/56–59, 138–141
See application file for complete search history.

(56) References Cited

U.S. PATENT DOCUMENTS 3,738,820 A * 6/1973 Osborne et al. ..... 65/19
3,912,487 A * 10/1975 Sharanov et al. ..... 65/141
4,758,260 A 7/1988 Geropp et al. ..... 65/19
5,082,483 A * 1/1992 Spencer et al. ..... 65/19
5,540,895 A * 7/1996 Faber et al. ..... 422/172
5,550,312 A * 8/1996 Schingnitz et al. ..... 588/320
2002/0015675 A1* 2/2002 Watson et al. ..... 423/574.1
2004/0237861 A1* 12/2004 Azuma et al. ..... 110/344

FOREIGN PATENT DOCUMENTS

DE 101 52 672 A1 4/2003

(Continued)

OTHER PUBLICATIONS

English Lanugage Machine Translation of Japanese Patent Publicatoin No. JP 08-245243 to Takai Kiyoshi.*

(Continued)

*Primary Examiner*—Steven P. Griffin
*Assistant Examiner*—Jason L. Lazorcik
(74) *Attorney, Agent, or Firm*—Ostrolenk Faber LLP

(57) ABSTRACT

In a process for granulating slag, from a blast furnace or a smelting reduction plant, in which a granule/water mixture formed during the granulation is fed to a granulation tank and then to a dewatering installation, in which the slag granules are dewatered. $H_2S$-containing vapors and gases formed during the granulation are at least partially condensed by injection of water in a condensation space which is flow-connected to the granulation tank. $H_2S$-containing residual gases are discharged from the compensation space below the water injection point, $H_2S$ is burnt.

12 Claims, 1 Drawing Sheet

FOREIGN PATENT DOCUMENTS

| | | |
|---|---|---|
| JP | 8-245243 | 9/1996 |
| LU | 88441 | 12/1993 |
| WO | WO 96/11286 | 4/1996 |

OTHER PUBLICATIONS

English Language Translation of Japanese Patent Publication No. JP 08-245243 to Takai Kiyoshi (English Lanugage Translation Date: Jan. 2009; Original Publication date: Sep. 24, 1996).*

International Search Report PCT/EP2004/010442 dated Nov. 3, 2004.

Radoux, H. et al. The New System for Producing Granulated Slag with Continuous Filtering and Conveyance, *Fachberichte Huttenpraxis Metallweiterverarbeitung*, vol. 20, No. 10, pp. 744-745, 1982.

* cited by examiner

PROCESS AND INSTALLATION FOR GRANULATING SLAG

CROSS REFERENCE TO RELATED APPLICATION

The present application is a 35 U.S.C. §§ 371 national phase conversion of PCT/EP2004/010442, filed 17 Sep. 2004, which claims priority of Austrian Application No. A 1525/2003, filed 25 Sep. 2003. The PCT International Application was published in the German language.

BACKGROUND OF THE INVENTION

The invention relates to a process for granulating slag, in particular from a blast furnace and/or a smelting reduction plant, in which a granule/water mixture formed during the granulation is fed to a granulation tank and then to a dewatering installation, in which the slag granules are dewatered, the $H_2S$-containing vapors and gases formed during the granulation being at least partially condensed by injection of water in a condensation space which is flow-connected to the granulation tank.

Hot slag coming out of a blast furnace or a smelting reduction plant is converted into granules, for example by rapid cooling and comminution using water. After the granulation, the granule/water mixture flows via a granulation tank or a passage to a dewatering installation, in which the slag sand is dewatered down to approx. 12% and then sold as a finished product.

The steam produced in the course of the granulation process and the sulfur-containing gases, $H_2S$ and small quantities of $So_2$, are generally passed into the atmosphere via a high stack or are precipitated in a condensation tower arranged above the granulation tank.

"Fachbericht Hüttenpraxis Metallweiterverarbeitung" [Specialist Report on Further Processing of Foundry Metals] (Vol. 20, No. 10, 1982, pp. 744-746) describes a process for producing slag granules, in which a vapor condenser can be installed in the stack and allows condensation of the vapors including a large proportion of condensable pollutants.

A process of the type described in the introduction is known from DE 35 11 958 C. In this case, the gas streams, comprising a steam/flue vapor mixture, the term flue vapor being understood to mean both air and pollutants, such as $H_2S$ and $SO_2$, are passed in a closed circuit and precipitated in a condensation tower using water containing calcium oxide.

However, one drawback of this process is that $H_2S$ and $SO_2$ are only precipitated using water down to defined residual concentrations.

The quantity of air which is sucked in or introduced into the system in some other way and the quantities of $H_2S$ produced fluctuate very considerably over the course of a tapping and from tapping to tapping as a function of slag rate, slag analysis, water circulation quantity, water temperature, wind speed, wind direction, shape and design of the granulation tube and other factors. The air introduced into the system leads to a slight superatmospheric pressure in other regions of the plant, in accordance with DE 35 11 958 C, and passes to atmosphere via granule ejector openings and other openings and via extractor hoods. However, the harmful gases also escape with the air into the atmosphere in an uncontrolled way in concentrations which are above the permitted limits.

According to another process, described in U.S. Pat. No. 5,540,895 A, the sulfur-containing flue gases are subjected, in a dedicated device in the condensation tower, to a chemical gas scrub by means of injection of an alkaline aqueous solution before they are discharged to atmosphere. However, this requires an additional chemical installation and concomitant consumption of chemicals.

SUMMARY OF THE INVENTION

It is an object of the invention to avoid the abovementioned problems and drawbacks and to provide a process and an installation for granulating slag in which the $H_2S$ content of the gases and vapors formed during the granulation is reliably eliminated, or at least reduced to below the permissible limit concentration, without the need for complicated fittings in an existing installation and without additional consumption of chemicals. Furthermore, it is intended to avoid the escape of $H_2S$-containing gases from other openings and unsealed areas in the installation and to minimize the quantity of air introduced into the system.

In a process for granulating slag of the type described in the introduction, this object is achieved, according to the invention, by the fact that $H_2S$-containing residual gases are discharged from the condensation space below the water injection point, and $H_2S$ is burnt.

During the combustion of $H_2S$, the less harmful component $SO_2$ is formed, the limits on which are at a higher level (limit for the emission of $H_2S$: 3 ppm; limit for the emission of $SO_2$: 350 ppm) and which is also easier to scrub out.

According to a preferred embodiment of the invention, the burning of $H_2S$ to form $SO_2$ is carried out in a combustion chamber. It is also easy for a combustion chamber of this type to be added to an existing installation.

To advantageously lower the level of $SO_2$ in the flue gases released to atmosphere, the combustion flue gas is cooled with water, and the $SO_2$ formed from $H_2S$ is precipitated.

A further preferred variant is characterized in that the residual gases, after they have been discharged from the condensation space, are passed in countercurrent to the hot slag, and in the process $H_2S$ is burnt to form $SO_2$, if appropriate with heat being supplied by means of an ancillary flame.

Preferably, the granulation tank is partitioned off in a gastight manner from the dewatering installation. This prevents the sulfur-containing gases and vapors formed mainly during the granulation process from escaping into the dewatering installation, and consequently the majority of these gases and vapors are precipitated by the injected water in the condensation space.

It is also preferable that a superatmospheric pressure is set in the granulation tank and in the condensation space below the water injection point. This is effected by means of the setting of the water injection. The superatmospheric pressure has the positive effect that the $H_2S$-containing residual gases are passed to the downstream combustion location, i.e. combustion chamber or slag channel, without the need for forced delivery means, such as fans or the like. Moreover, the quantity of air introduced using the granulation device is reduced, and therefore so is the quantity of air and the $H_2S$ level which are discharged from the system.

According to another preferred embodiment, vapors and gases formed in the dewatering installation are passed into the condensation space above the water injection point. These in some cases sulfur-containing vapors and gases can be precipitated in the condensation space and/or fed for combustion as $H_2S$-containing residual gases.

Preferably, a subatmospheric pressure is set in the condensation space above the water injection point.

If a gas barrier is present, a subatmospheric pressure is formed, for example, in the parts of the installation connected downstream of the granulation tank, as a result of a gas connection to the condensation space above the water injection point, with the result that it is impossible for any vapors and gases to escape in an uncontrolled manner from openings and unsealed locations, but rather these vapors and gases are extracted into the condensation space.

Preferably, the quantity of vapor and gas passed into the condensation space by means of a sucking action is controlled by means of the quantity of water injected and is kept at a minimum. As a result, the quantity of $H_2S$ discharged with the air and also the energy consumption of the installation are minimized.

A further preferred variant of the invention is characterized in that condensate formed in the condensation space and injected water are discharged from the condensation space and fed to the water which has been separated off in the dewatering installation and is recirculated for granulation and water injection.

Expediently, the quantity of injected water is controlled as a function of the slag rate.

The installation according to the invention for granulating slag comprises a slag channel for delivering the hot slag to a granulation device, preferably a spray head, a downstream granulation tank for holding a granule/water mixture, a condensation device, preferably a condensation tower, which is flow-connected to the granulation tank and has a water feed and a device for injecting water, and a granule dewatering installation, is characterized in that a discharge for discharging vapors and gases, which is pipe-connected to a combustion chamber, is provided in the condensation device below the device for injecting water.

According to another aspect, the installation according to the invention for granulating slag comprises a slag channel, which is provided with an extractor hood, for delivering the hot slag to a granulation device, preferably a spray head, a downstream granulation tank for holding a granule/water mixture, a condensation device, preferably a condensation tower, which is flow-connected to the granulation tank and has a water feed and a device for injecting water, and a granule dewatering installation, is characterized in that a discharge for discharging vapors and gases, which opens out into the slag channel between the granulation device and the extractor hood, is provided in the condensation device below the device for injecting water.

According to a preferred embodiment, a water cooler for the combustion flue gases is provided downstream of the combustion chamber and/or downstream of the extractor hood of the slag channel.

This water cooler is used to cool the combustion flue gases and to scrub out or precipitate the $SO_2$ formed as a result of the combustion.

Preferably, the slag channel comprises a burner for generating an ancillary flame, which burner can be switched on as a function of the slag channel temperature. As a result, the slag channel can be heated to the temperature required for the combustion of $H_2S$ after it has been inoperative for a prolonged period of time.

A preferred variant of the installation according to the invention is characterized in that the granule dewatering installation comprises at least one dewatering device and a water basin, which are provided with a covering hood, and a discharge line for discharging vapors and gases, which opens out in the condensation device above the device for injecting water, leads away from the covering hood.

Expediently, a gas barrier is provided between the granulation tank and the granule dewatering installation.

Furthermore, it is preferable that a means for trapping water and condensate is provided in the condensation device below the device for the injection of water, from which means leads a discharge line which opens out into the granule dewatering device, in particular the water basin.

Preferably, the granule dewatering installation, in particular the water basin, is pipe-connected to the water feed of the condensation device and/or the granulation device.

BRIEF DESCRIPTION OF THE DRAWINGS

The invention will now be explained in more detail with reference to the drawing, in which the FIGURE provides a diagrammatic illustration of an installation according to the invention.

DESCRIPTION OF A PREFERRED EMBODIMENT

Figure 1:
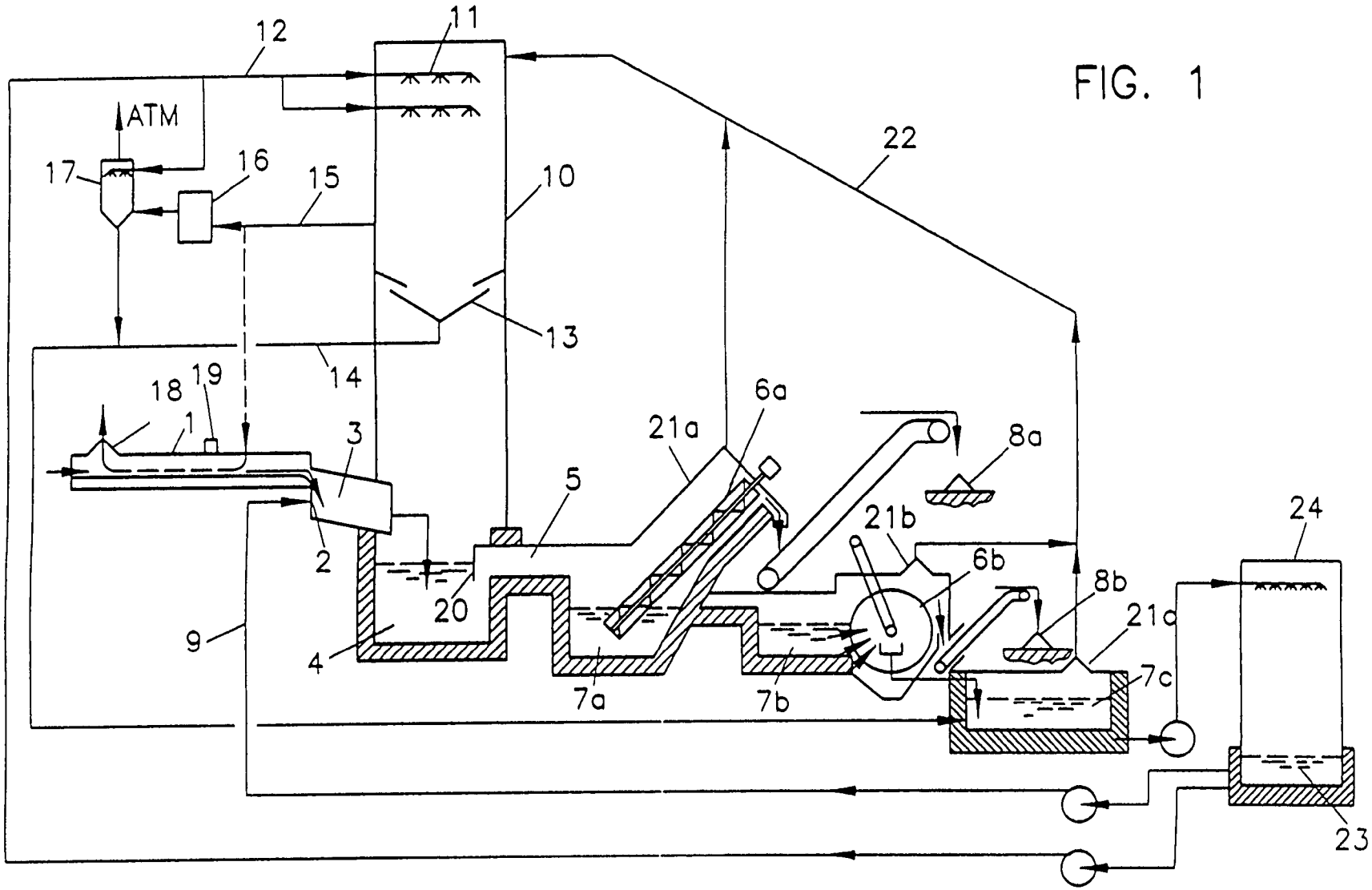

According to the FIGURE, hot slag from a blast furnace and/or a smelting reduction plant is passed through a slag channel 1, in the direction indicated by the arrow, to a granulation device 2, for example a spray head, where it is cooled and comminuted by spraying in water. The granule/water mixture formed passes via a granulation tube 3 into a granulation tank 4 and, from there, through a passage 5 into a granule dewatering installation, comprising dewatering devices 6*a* and 6*b*, for example screw conveyors, drum filters, etc., and water basins 7*a*-7*c*. In the dewatering installation, the granules are dewatered and the slag sand is stored at storage areas 8*a* and 8*b*. The water which is separated off in the water basins 7*a*-7*c*, after replacement of the losses and cooling in a cooling tower 24, is returned as process water from the collection tank 23 of the cooling tower 24 via a line 9 to the granulation device 2.

The sulfur-containing vapors and gases formed during the granulation are precipitated in a condensation tower 10 arranged above the granulation tank 4. A device 11 for the injection of water, which is supplied with water containing calcium oxide via a water feed 12 fed from the collection tank 23, is arranged in the upper part of the condensation tower 10. A means 13 for trapping water and condensate, for example formed by water collection channels, is arranged in the lower part of the condensation tower 10, i.e. below the device 11, and this means 13 is connected to the water basin 7*c* via a discharge line 14.

The $H_2S$-containing residual gases and vapors which have not been condensed or precipitated are extracted from the condensation tower 10 via a discharge line 15 below the device 11 and above the means 13 and fed to a temperature-controlled combustion chamber 16, where the $H_2S$ is burnt to form $SO_2$. The combustion flue gases are then cooled in a water cooler (or scrubber) 17 supplied by the water feed 12, and the $SO_2$ contained therein is scrubbed out or precipitated. The flue gas from which $H_2S$ and $SO_2$ have been removed is then released to atmosphere. The scrubbing water is fed into the discharge line 14.

Alternatively, the discharge line 15 opens out (as illustrated by dashed lines) in the slag channel 1, specifically between the granulation device 2 and an extractor hood 18 provided above the slag channel 1. In the slag channel 1, the residual gases are passed in countercurrent to the hot slag, and in the process $H_2S$ is burnt to form $SO_2$. The distance between the point at which the discharge line 15 opens into the slag channel 1 and the extractor hood 18 ensures that the residual gases can be heated to the temperature required for the combustion of $H_2S$ and that sufficient time is available for the combustion. To supply additional heat in the event of a prolonged shutdown or a drop in the slag temperature, a burner 19 for generating an ancillary flame is provided in the slag channel 1. The combustion flue gases are discharged via the extractor hood 18 and if appropriate fed to the water cooler 17 or a dedusting device.

The granulation tank 4 is closed off with respect to the passage 5 and subsequently with respect to the granule dewatering installation by a gas barrier 20, which allows only the granule/water mixture to pass into the passage 5 and the dewatering installation but retains the vapors and gases in the granulation tank 4 and in the condensation tower 10.

As a result of the injection of water via the device 11, a superatmospheric pressure is generated in the lower part of the condensation tower 10, i.e. below the water injection point, and in the granulation tank 4. On account of this superatmospheric pressure, the residual gases are fed via the discharge line 15 to the combustion chamber 16 or to and through the slag channel 1 without the need for forced delivery devices.

The dewatering devices 6*a*, 6*b* with the water basins 7*a* and 7*b* and the last water basin 7*c* are provided with covering hoods 21*a*-21*c*, from which a discharge line 21 for any vapors and gases formed in the dewatering installation, which may contain sulfur, leads away, opening out into the condensation tower 10 above the device 11. In this way, harmful flue gases which are not formed as early as in the granulation tank 4, from where they would rise into the condensation tower 10, can likewise be fed for purification and in particular combustion.

On account of the injection of water in the condensation tower 10 and the gas barrier 20, a subatmospheric pressure, which ensures that the vapors and gases are extracted via the discharge line 22 into the condensation tower 10, is formed in the granule dewatering installation, i.e. in the passage 5 and in the parts of the installation below the covering hoods 21*a*-21*c*. This prevents harmful $H_2S$-containing gases from passing into atmosphere in an uncontrolled way via openings or unsealed locations in the granule dewatering installation. As a result, it is even possible, for example, for a drum filter used as dewatering device to be cleaned by means of compressed air.

Advantageously, measuring and/or control devices (not shown) are provided in the discharge line 22 and the water feed 12, so that the quantity of vapor and gas extracted from the dewatering installation can be controlled by means of the quantity of water injected into the condensation tower 10 and can be kept to a minimum. Measuring instruments are also provided for determining the slag rate in order also to enable the quantity of water injected to be controlled as a function of this rate.

The invention claimed is:

1. A process for granulating slag from a blast furnace or a smelting reduction plant, comprising:

feeding a granule/water mixture that was formed during granulation and combustion flue gas including $H_2S$-containing vapors to a granulation tank and then to a dewatering installation, and dewatering the granules in the dewatering installation;

at least partially condensing the $H_2S$-containing vapors and gases formed during the granulation by injecting water in a condensation space which is flow-connected to the granulation tank, the water injection being at a water injection point;

discharging $H_2S$-containing residual gases from the condensation space below the water injection point, and burning $H_2S$ from the condensation space; and after the residual gases have been discharged from the condensation space, passing the residual gases through a hot slag channel in countercurrent to a flow direction of hot slag therethrough, thereby burning $H_2S$ to form $SO_2$.

2. The process as claimed in claim 1, further comprising the burning of the $H_2S$ is in a combustion chamber.

3. The process as claimed in claim 1, further comprising cooling the combustion flue gas with water, and precipitating $SO_2$ formed from the $H_2S$-containing vapors.

4. The process as claimed in claim 1, further comprising partitioning off the granulation tank in a gastight manner from the dewatering installation.

5. The process as claimed in claim 1, further comprising setting a superatmospheric pressure in the granulation tank and in the condensation space below the water injection point.

6. The process as claimed in claim 1, further comprising passing vapors and gases formed in the dewatering installation into the condensation space above the water injection point.

7. The process as claimed in claim 6, further comprising setting a subatmospheric pressure in the condensation space above the water injection point.

8. The process as claimed in claim 6, further comprising controlling the quantity of vapor and gas passed into the condensation space by a sucking action by means of the quantity of water injected so that the quantity of vapor and gas is kept at a minimum.

9. The process as claimed in claim 1, further comprising discharging condensate formed in the condensation space and injected water from the condensation space and feeding the discharged condensate to water which has been separated off in the dewatering installation and recirculating the condensate for granulation and water injection.

10. The process as claimed in claim 1, further comprising controlling the quantity of injected water as a function of slag rate.

11. The process as claimed in claim 1, wherein the $H_2S$ is burned with heat being supplied by means of an ancillary flame.

12. The process as claimed in claim 1, wherein the residual gases are passed through the hot slag channel such that the residual gases can be heated to the temperature required for the combustion of $H_2S$ with sufficient time available for the combustion of H2S.

* * * * *